US005078390A

United States Patent [19]

Hurt

[11] Patent Number: 5,078,390

[45] Date of Patent: Jan. 7, 1992

[54] CONNECTING ROD STAIR CLIMBER

[75] Inventor: Charles R. Hurt, Jonesboro, Ark.

[73] Assignee: Spirit Manufacturing, Inc., Jonesboro, Ark.

[21] Appl. No.: 406,558

[22] Filed: Sep. 13, 1989

[51] Int. Cl.[5] ..... A63B 23/04

[52] U.S. Cl. ..... 272/70; 272/130

[58] Field of Search ..... 272/69, 70, 125, 126, 272/130, 134

[56] References Cited

U.S. PATENT DOCUMENTS

| | | | |
|---|---|---|---|
| 3,970,302 | 7/1976 | McFee | 272/70 X |
| 4,496,147 | 1/1985 | DeCloux et al. | 272/130 |
| 4,667,955 | 5/1987 | Giesch | 272/130 |
| 4,830,362 | 5/1989 | Bull | 272/70 |
| 4,834,364 | 5/1989 | Gongwer et al. | 272/126 X |
| 4,838,543 | 6/1989 | Armstrong et al. | 272/130 X |
| 4,850,585 | 7/1989 | Dalebout | 272/70 |

FOREIGN PATENT DOCUMENTS

| | | | |
|---|---|---|---|
| 2416778 | 10/1974 | Fed. Rep. of Germany | 272/70 |

*Primary Examiner*—Robert Bahr

*Attorney, Agent, or Firm*—Crutsinger & Booth

[57] ABSTRACT

An exercising device having a stationary frame and a pair of foot supporting beams pivotally secured to the stationary frame. A crank assembly is pivotally secured about a transverse axis to a post on the stationary frame above a pivot pin securing foot engaging beams to the post such that connecting rods secured between spaced-apart cranks and the beams cause the beams to move oppositely in unison as the weight of a user is alternately applied to the unsupported ends of the beams.

6 Claims, 4 Drawing Sheets

CONNECTING ROD STAIR CLIMBER

TECHNICAL FIELD

An improved connecting rod structure for causing a pair of beams in a device to simulate stair climbing exercise is disclosed.

BACKGROUND OF INVENTION

Jogging and stair climbing are recommended exercises for strengthening leg muscles and the cardiovascular system. However, physicians have concluded that in some cases jogging and stair climbing transmit substantial shock loading to bones and joints of the human body which may be injurious.

Low impact exercise equipment of the type disclosed in U.S. Pat. No. 4,838,543 incorporates a structure which is used similarly to a stationary bicycle wherein the user stands on a pair of foot beams pivotally connected to a stationary frame. Shock absorbers are connected between the stationary frame and the foot beams to resist pivotal movement of each foot beam relative to the stationary frame. A rope is connected over a pulley mounted on the stationary frame above the foot beams for elevating the end of one beam when a downward force is applied to the other beam.

U.S. Pat. No. 4,830,362 entitled "FULL BODY, SHOCK-FREE AEROBIC AND ANAEROBIC EXERCISING MACHINE FOR USE IN THE STANDING POSITION" discloses a pair of foot beams pivotally mounted to a stationary frame in combination with a pair of handle bars pivotally mounted to the frame. The foot beams and handle bars are pivotally connected by tie rods and rocker arms such that rotation of a lower foot beam on either side of the frame in one direction causes rotation of the upper handle bars on the same side of the frame in the opposite direction for synchronizing movement of the foot beams and the handle bars. The system of rocker arms and tie rods is devised to simultaneously exercise upper and lower body parts while the person exercising is in a standing position on a stationary machine.

The operation of the foot beams of each of the aforementioned patents is similar except that movement of the foot beams of one apparatus is synchronized by a rope and pulley system while a rocker arm and a pair of connecting rods synchronize the foot beams of the other system. The rocker arm pivots about a longitudinal axis. The rocker arm and connecting rods used in one of the systems are mounted below the pivot point of the foot beams such that the connecting rods connected to opposite ends of the rocker arm are loaded in compression during operation of the apparatus. Thus, the tie rods may tend to wobble as the foot beams are reciprocated in view of the arcuate movement of the respective members resulting in stress and excessive wear to bearing structures.

SUMMARY OF INVENTION

The exercising device disclosed herein incorporates a pair of cranks secured to opposite ends of a transverse crankshaft which is pivotally secured to a stationary post above a pivot point for a pair of cantilever mounted foot beams. A pair of connecting rods is connected between the cranks and the foot beams such that the connecting rods are loaded in tension as the foot beams move through a complete cycle of operation.

The apparatus incorporates an improved frame construction incorporating a base member which is telescopically connected adjacent the lower end of an upright post to permit assembly and disassembly of the frame quickly and with a minimum of tools to facilitate packaging and shipment of the exercise device. Improved beam construction includes channel shaped members having a connecting rod extending through a passage formed intermediate opposite ends of the beam to facilitate connecting the connecting rod to engage the lower surface of the beam for applying a tension force through the connecting rod to the crank arms.

DESCRIPTION OF THE DRAWING

Drawings of a preferred embodiment of the invention are annexed hereto so that the invention may be better and more fully understood, in which:

Numeral references are employed to designate like parts throughout the various figures of the drawing.

Referring to FIG. 1 of the drawing, the numeral 10 generally designates a stair climber exercise device having a pair of cantilever mounted beam assemblies 20 pivotally secured to a stationary frame, movement of beam assemblies 20 being synchronized by a crank assembly 40. Beam assembly **20*a* on the right side and beam assembly 20*b*** on the left side of the exercise device are of substantially identical construction except for slight variations in the foot supporting pads on the free ends of the beam members.

Figure 1:
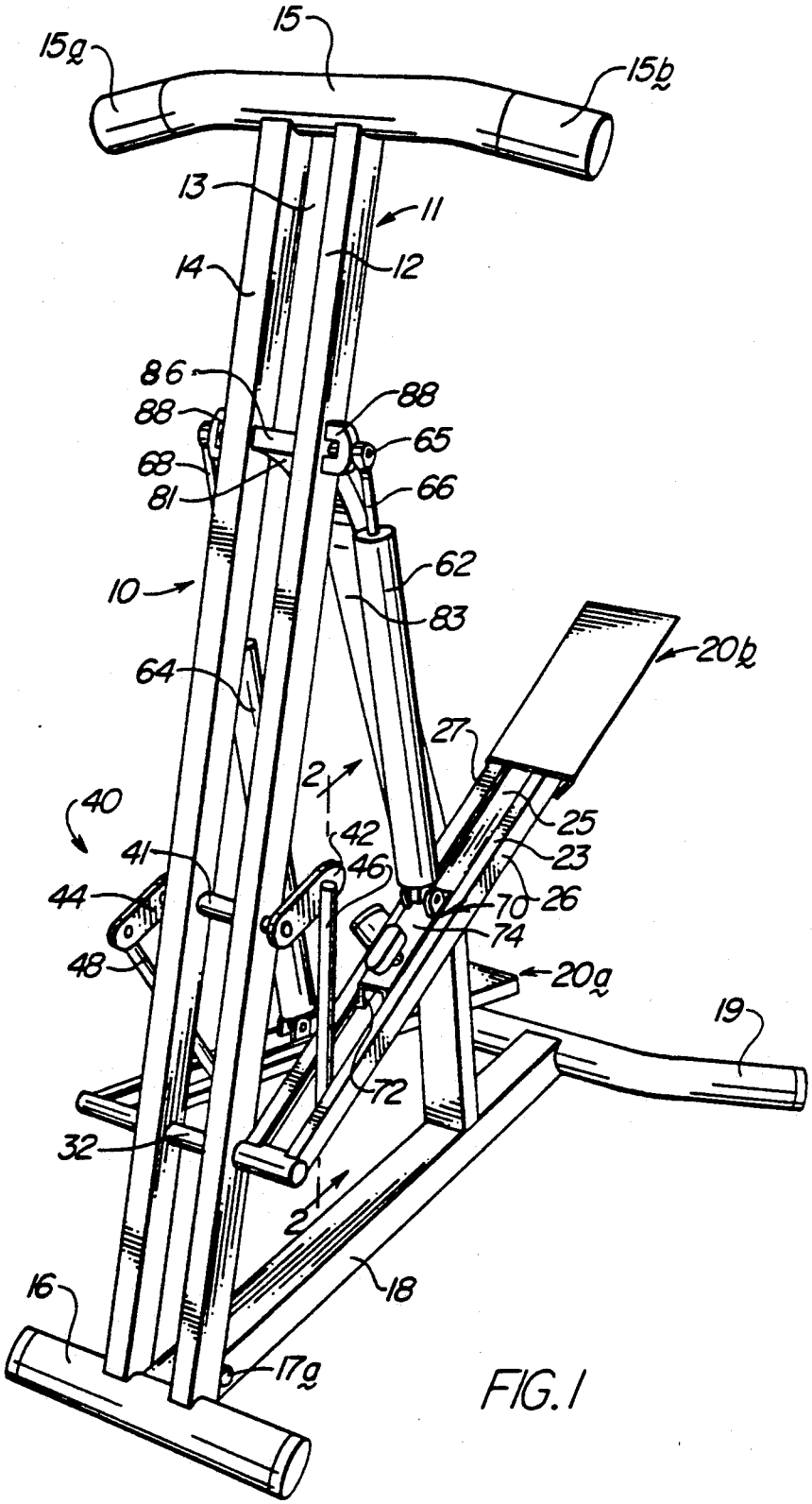
FIG. 1 is a perspective view of a stair climber incorporating the improvements of the invention.

The frame of exercising device 10 comprises a generally upright post 11 formed by spaced stanchions 12 and 14 having upper ends welded or otherwise secured to a hollow tubular handle bar 15 and lower ends welded or otherwise secured to a generally horizontally disposed floor engaging foot member 16. Hand grips **15*a* and 15*b* are preferably secured to opposite ends of handle bar 15**.

Figure 4:
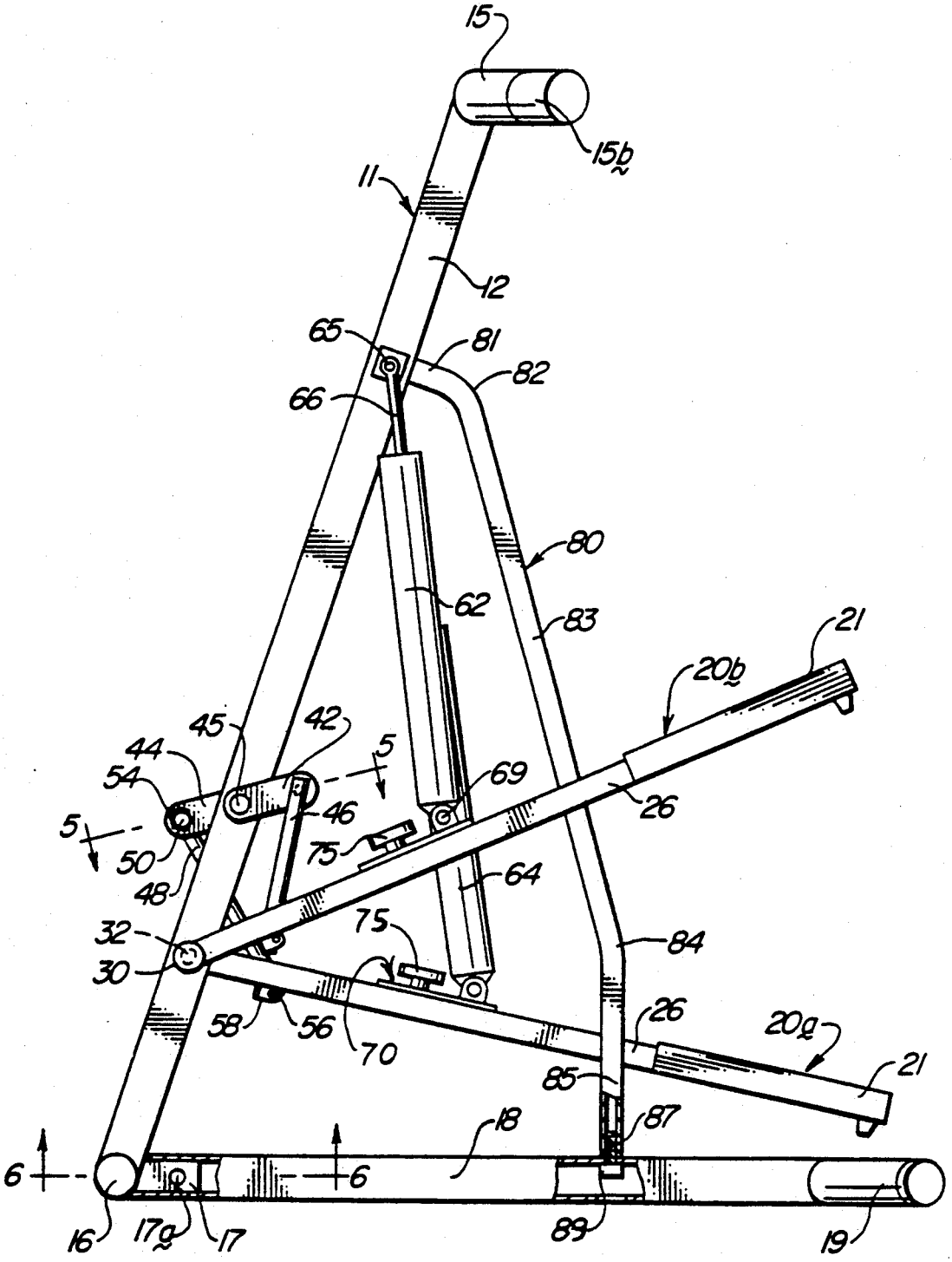
FIG. 4 is a right side elevational view thereof.

As best illustrated in FIG. 4 of the drawing, foot 16 has a pin 17 welded or otherwise secured thereto between stanchions 12 and 14 adjacent the lower end of the post. As will be hereinafter more fully explained, handle bar 15 and foot 16 are preferably rigidly secured adjacent opposite ends of spaced stanchions 12 and 14 to form a rigid frame member in which the parts are connected to produce continuity at the joints and to permit the entire post assembly 11 to behave as a unit. The members are preferably hollow tubular members having substantial stiffness while minimizing the overall weight of the fabricated assembly. The angle between stanchions 12 and 14 and pin 17 is preferably approximately 75°, which causes the central post 11 to be inclined at an angle of, for example, 15° relative to a vertical plane, as will be hereinafter more fully explained.

Figure 2:
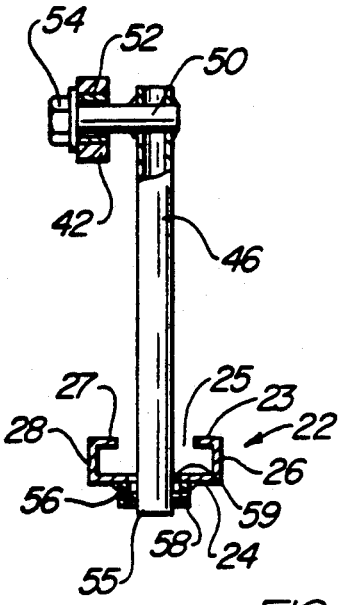
FIG. 2 is a cross-sectional view taken alone line 2—2 of FIG. 1.

As best illustrated in FIG. 2 of the drawing, each beam assembly 20 is preferably formed of a channel shaped member 22 having a substantially continuous web portion 24 and flanges 26 and 28 adjacent opposite sides thereof. Ledges 23 and 27 project inwardly from upper edges of flanges 26 and 28 and adjacent edges of ledges 23 and 27 are spaced apart to provide a slot 25 extending longitudinally of each beam member 22.

Foot support pads 21 are secured to the unsupported outer ends of each beam 20*a* and 20*b* and are adapted to transfer the weight of a user to ends of the beam.

Figure 6:
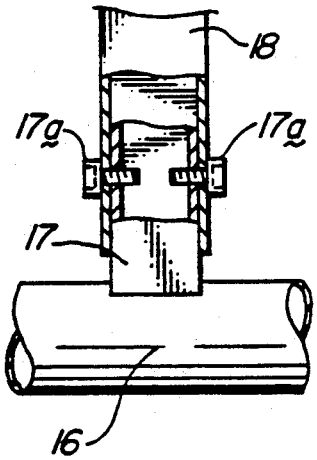
FIG. 6 is a cross-sectional view taken alone line 6—6 of FIG. 4.

Base member 18 preferably comprises a hollow tubular member having a hollow rectangular shaped central passage into which pin 17 welded or otherwise secured to foot 16 extends. As best illustrated in FIGS. 4 and 6 of the drawing, cap screws 17*a* extend through aligned apertures formed in side walls of member 18 and into threaded passages in pin 17 for securing the members together.

Figure 3:
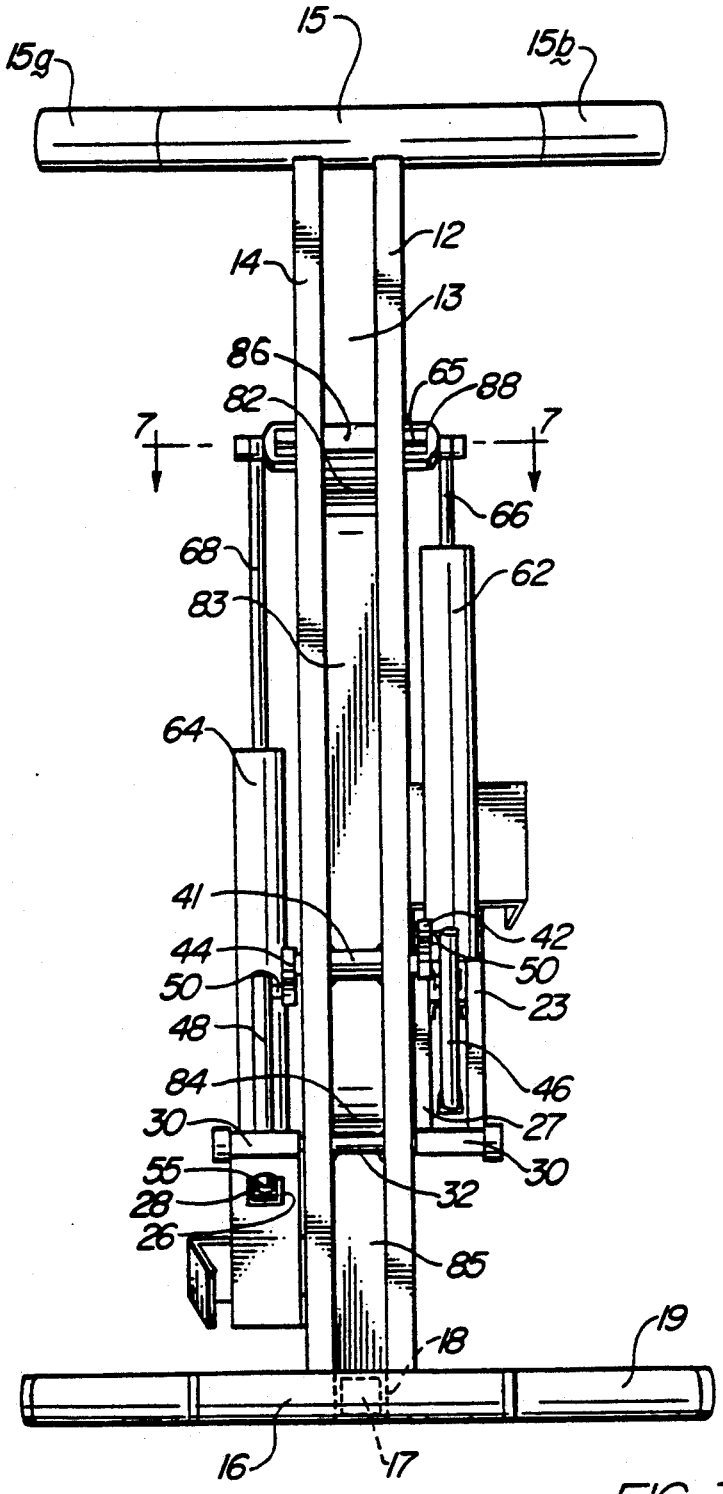
FIG. 3 is a front elevational view of the stair climber.

As best illustrated in FIGS. 1 and 3 of the drawing, each beam member 22 has a hollow tubular sleeve 30 secured to the front end thereof having a hollow passage extending therethrough into which opposite ends of a pivot pin 32 extend. The pivot pin 32 preferably extends through apertures formed in stanchions 12 and 14 and is welded or otherwise secured relative to the stanchions to prevent longitudinal movement. To prevent longitudinal movement of each sleeve 30 relative to pivot pin 32, a snap ring or lock nuts may be employed.

A tubular bushing (not shown) is installed between the inner walls of each sleeve 30 and the outer wall of pivot pin 32, the bushing preferably being removable for replacement and lubrication.

Figure 5:
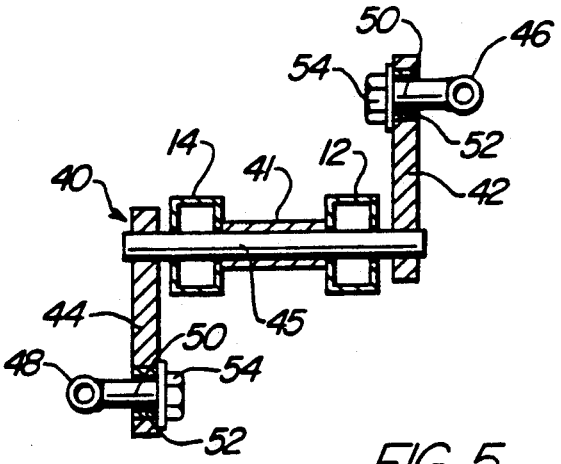
FIG. 5 is a cross-sectional view taken along line 5—5 of FIG. 4.

As best illustrated in FIGS. 1 and 5 of the drawing, connecting rod assembly 40 comprises crank arms 42 and 44 secured to opposite ends of a crankshaft 45 which extends through a hollow sleeve 41 welded or otherwise secured between stanchions 12 and 14 and having a central passage having opposite ends aligned with openings formed through stanchions 12 and 14.

As best illustrated in FIG. 4 of the drawing, crank 44 extends outwardly from crankshaft 45 at an angle of approximately 180° relative to crank 42, crank 44 extending toward the front of the exercising apparatus while crank 42 extends toward the rear of the apparatus. In the illustrated embodiment, when beams 20*a* and 20*b* are positioned such that upper surfaces thereof lie in a horizontal plane, crank arms 42 and 44 are horizontally disposed.

As illustrated in FIGS. 2 and 5 of the drawing, connecting rods 46 and 48 are preferably equal length and are preferably hollow tubular members having a perforated upper end to provide openings through which a stub shaft 50 extends. Stub shaft 50 is preferably welded or otherwise rigidly secured to the upper end of each connecting rod 46 and 48 and one end thereof extends through a bushing 52 in an aperture formed in each crank arm 42 and 44. The outer end of stub shaft 50 is preferably threaded to receive a nut 54 for detachably securing stub shaft 50 and connecting rod 46 to crank arm 42.

The lower end of each connecting rod 46 and 48 has a rod eye 55 secured to the lower end thereof through which a pin 56 extends into aligned openings formed in rearwardly projecting ears of a bracket 58 welded to a downwardly depending tab stamped from the web 24 of beam 22. Rod eyes 55 and the lower ends of connecting rods 46 and 48 extend through an opening 59 in web 24 of each beam 22 while upper ends of connecting rods 46 and 48 are pivotally secured by stub shaft 50 to cranks 42 and 44, respectively.

Shock absorbers 62 and 64 having rods 66 and 68 are mounted to resist movement of beams 20*a* and 20*b* relative to the stationary frame. A piston (not shown) is secured to the end of each rod 66 and 68 and is slidably disposed in cylinders 62 and 64. Each of the rods 66 and 68 of shock absorbers 62 and 64 has a rod eye formed on the upper end thereof which is pivotally secured to a shaft 65, as will be hereinafter more fully explained.

The base end of each cylinder 62 and 64 has a lug secured thereto which is pivotally secured by a pin 69 to upwardly extending lugs on a slide member 70.

The slide 70 comprises a pair of generally L-shaped members 72 having outwardly extending legs which engage lower surfaces of ledges 23 and 27, upper ends of vertically extending legs being connected by a plate 74 having spaced lugs 76 welded or otherwise secured thereto for receiving pivot pin 69 for securing the lug on the lower end of cylinders 62 and 64 to the slide 70.

Slide member 70 has an adjustable friction brake mechanism mounted therein to permit adjustment of slide 70 longitudinally of each beam 22 for adjusting the distance between pivot pin 32 and the point at which shock absorbers 62 and 64 are pivotally connected to each beam 22. This structure permits adjustment of the mechanical advantage and consequently the force required for reciprocating each pedal 20 relative to the stationary frame. A knob or handle 75 on the upper end of a screw is threadedly secured through plate 74 for locking the slide 70 to prevent movement of the slide 70 longitudinally of channel member 22. However, when knob 75 is rotated for disengaging the screw from channel 22, plate 74 is movable longitudinally of slot 25 in channel member 22 for adjusting the point of attachment of shock absorbers 62 and 64 longitudinally of beam members 20*a* and 20*b*.

Referring to FIG. 4 of the drawing, a brace member, generally designated by the numeral 80, is an elongated hollow tubular member having an upper end section 81 connected to a central section 83 by a curved transition section 82. A curved transition section 84 is formed between the lower end section 85 and the central section 83. The upper end section 81 is closed by a closure member 86 welded or otherwise secured across the end of the hollow interior of brace member 80.

Figure 7:
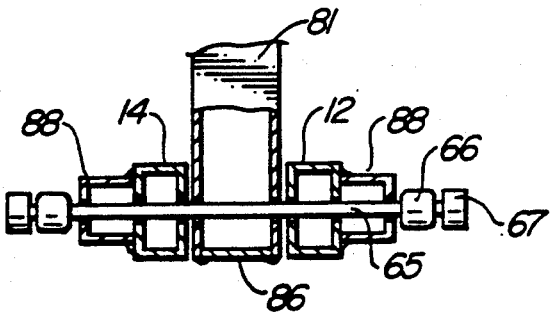
FIG. 7 is a cross-sectional view taken along line 7—7 of FIG. 3.

As illustrated in FIG. 7 of the drawing, shaft 65 extends through aligned apertures formed through stanchions 12 and 14 and through the upper end section 81 of brace member 80. The rod eyes on the ends of rods 66 and 68 of the shock absorbers are pivotally secured to opposite ends of shaft 65 and are held in position by snap rings 67.

Snap rings 67 are preferably detachably secured to opposite ends of shaft 65 to permit replacement of shock absorbers 62 and 64 and to permit removal of shaft 65 for disconnecting the upper end section 81 of brace 80 from the slot between stanchions 12 and 14 of post 11.

A generally U-shaped spacer member 88 is welded or otherwise secured to outer surfaces of stanchions 12 and 14 for positioning the axis of each rod 66 and 68 and each cylinder 62 and 64 in spaced substantially vertical parallel planes and to assure that the axes remain in the vertical planes as beam members 20*a* and 20*b* reciprocate vertically.

From the foregoing it should be readily apparent that connecting rods 46 and 48 receive only tension loading when a downwardly directed force is applied to one of the foot support pads 21 on the cantilever mounted foot support beams 20*a* and 20*b*. Since the crankshaft 45 extends through spaced stanchion members 12 and 14 forming post 11, a clockwise torque applied to the crankshaft 45 by connecting rod 46 and crank 42 rotates the end of crank 44 and the upper end of connecting rod 48 upwardly for rotating beam 20*a* in a counterclockwise direction about pivot pin 32. It should be appreciated that since foot support beams 20*a* and 20*b* and cranks 42 and 44 rotate about spaced horizontally disposed parallel axes, application of lateral forces is substantially eliminated.

Post 11 formed by spaced stanchions 12 and 14 having lower ends welded to foot member 16 forms a strong rigid structure supporting pivot pin 32 an crankshaft 45 intermediate opposite ends of post 11. It should be appreciated that forces exerted on beam members 20*a* and 20*b* result in application of vertical loading to post 11 inwardly of foot member 16 tending to rotate post 11 in a clockwise direction as viewed in FIG. 4 of the drawing. However, brace 80 having an upper section 81 pivotally secured by shaft 65 to post 11 and a lower end 85 secured by cap screw 89 threadedly secured in the threaded plug 87 of brace member 80 exerts force on inclined post 11 in a clockwise direction. Post 11, brace member 80 and base member 18 form a generally triangular shaped frame structure exhibiting exceptional rigidity while maintaining a minimum weight for the structure. The stability of the structure is significantly increased by the provision of spaced stanchions 12 and 14 forming a slot 13 therebetween into which the upper end section 81 of brace member 80 extends.

An important feature of the frame is the provision of joints in the structure to facilitate assembly and disassembly of the frame. When cap screws 17*a* and 89 are removed, base member 18 can be disengaged from the tubular pin 17 on foot member 16 and from the lower end 85 of the brace member 80. The brace member 80 and the beam members 20 can be rotated toward the post 11 about shaft 65 and pivot pin 32 respectively. The components can thus be packaged in a relatively flat shipping box or container and quickly assembled with a minimum of effort.

From the foregoing it should be readily apparent that the stair climber 10 provided with the crank assembly 40 is particularly adapted to overcome many of the disadvantages of prior art devices. It should be appreciated that other and further configurations of the apparatus may be devised without departing from the basic concept of the invention.

I claim:

1. An exercising device comprising: base means; post means; means securing said post means to said base means; brace means having first and second ends; means pivotally securing said first end of said brace means to said post means; means detachably securing said second end of said brace means to said base means; a pair of beam members; means pivotally securing one end of each beam member to said post means such that each beam member is rotatable about a first axis and has an unsupported end; a crankshaft; means rotatably securing said crankshaft relative to said post means for rotation about a second axis which is parallel to and positioned above said first axis; a pair of cranks, said cranks being secured to said crankshaft adjacent opposite sides of said post means with one of said cranks being rotated 180 degrees relative to the other of said cranks; and connector means secured between said cranks and said beam members between opposite ends of said beam members, said connector means being adapted to move said beam members in unison in opposite directions.

2. An exercising device according to claim 1, each of said beam members comprising a generally channel shaped member having a web and an upwardly opening slot, said web having an opening formed therein, said connector means extending through said opening in said web of said generally channel shaped member; and means pivotally securing said connector means to said web.

3. An exercising device according to claim 1, with the addition of resistance means; and means securing said resistance means between said post means and said beam members to resist pivotal movement of said beam members relative to said post means.

4. An exercising device according to claim 3, said means pivotally securing said resistance means to said beam members comprising: slide means; and means movably securing said slide means to said beam members to permit adjustment of said slide means longitudinally of said beam members.

5. An exercising device according to claim 1, said post means comprising a pair of spaced stanchions; a bearing sleeve secured between said stanchions, said crankshaft extending through said bearing sleeve.

6. An exercising device comprising: a pair of spaced stanchions; brace means having upper and lower sections, said upper section of said brace means extending between said pair of spaced stanchions; shaft means pivotally securing said upper section of said brace means between said pair of spaced stanchions; a pair of beam members; means pivotally securing one end of each of said beam members to one of said spaced stanchions such that each beam member is rotatable about a first axis and has an unsupported end; first and second resistance means secured to opposite ends of said shaft means; means securing said first and second resistance means to said beam members to resist pivotal movement of said beam members relative to said spaced stanchions; base means; means detachably securing said base means to each of said spaced stanchions; means detachably securing said lower end section of said brace means to said base means; and means for synchronizing movement of said beam members, said synchronizing means being operable when one of said beam members is moving downwardly to cause the other of said beam members to move upwardly.

* * * * *